US007172512B2

(12) United States Patent
Be

(10) Patent No.: US 7,172,512 B2
(45) Date of Patent: Feb. 6, 2007

(54) FRAME SUPPORT MEMBER FOR RECREATIONAL SWING

(76) Inventor: Be Be, 2126 Gray St., Edgewater, CO (US) 80214-1137

( * ) Notice: Subject to any disclaimer, the term of this patent is extended or adjusted under 35 U.S.C. 154(b) by 61 days.

(21) Appl. No.: 10/990,816

(22) Filed: Nov. 17, 2004

(65) Prior Publication Data

US 2006/0128483 A1 Jun. 15, 2006

(51) Int. Cl.
*A63G 9/12* (2006.01)
*A63G 9/00* (2006.01)

(52) U.S. Cl. ..... 472/118; 248/163.2; 297/273; 135/135

(58) Field of Classification Search ..... 472/118–125; 248/163.2, 164, 168; 297/273, 274; 135/135
See application file for complete search history.

(56) References Cited

U.S. PATENT DOCUMENTS

| | | | | |
|---|---|---|---|---|
| 390,851 | A | 10/1888 | Folks | |
| D55,384 | S | 6/1920 | Kingsbury et al. | |
| 1,390,502 | A | 9/1921 | Clouser | |
| 1,806,454 | A | 5/1931 | Goudeau | |
| 1,866,175 | A | 7/1932 | Rogers, Jr. | |
| D154,276 | S | 6/1949 | Jones | |
| 2,524,967 | A | 10/1950 | Ellis | |
| 2,860,689 | A | 11/1958 | Baker | |
| 3,058,744 | A | 10/1962 | McGuire | |
| 3,130,969 | A | 4/1964 | Groth | |
| 3,344,443 | A | 10/1967 | Bonnell | |
| 3,674,262 | A | 7/1972 | Tomalinas, Jr. | |
| 3,966,202 | A | 6/1976 | Cynamon | |
| 4,120,280 | A * | 10/1978 | Iverson et al. | 126/30 |
| 4,159,113 | A | 6/1979 | Callecod | |
| 4,717,108 | A * | 1/1988 | Liedle | 248/432 |
| 4,738,444 | A | 4/1988 | Linden | |
| D355,013 | S | 1/1995 | Schechner | |
| 5,884,646 | A * | 3/1999 | Ju | 135/135 |
| 6,174,266 | B1 | 1/2001 | Merrill | |
| 6,178,978 | B1 | 1/2001 | Rieber | |
| D466,315 | S | 12/2002 | Egnatovich, Jr. | |

FOREIGN PATENT DOCUMENTS

| | | |
|---|---|---|
| GB | 2053702 | 2/1981 |

* cited by examiner

*Primary Examiner*—Kien Nguyen
(74) *Attorney, Agent, or Firm*—Ellen Reilly; John E. Reilly

(57) ABSTRACT

A support frame for a suspension device includes a plurality of leg members attached at their upper portion to a mounting plate. The mounting plate has pivot members and circumferential openings for connecting the leg members. There are also height adjustment members as well as a number of optional features to facilitate use of the suspension framework.

28 Claims, 4 Drawing Sheets

FRAME SUPPORT MEMBER FOR RECREATIONAL SWING

BACKGROUND AND FIELD OF INVENTION

This invention relates to a frame support member; and more particularly relates to a novel and improved support member for a recreational swing or the like.

Currently, there exist a number of suspension frames for swings, such as, U.S. Pat. No. 1,866,175 to Rogers and U.S. Pat. No. 6,178,978 to Rieber. While these frames are designed to carry an infant load, they are not sufficiently stable to support a heavier adult load. Further, typical suspension frames for adults are difficult to assemble and often unstable. There is an unmet need for a suspension framework that is durable and easy to assemble, adequately supports a suspension swing or vehicle as well as the user of the suspension device, is extremely stable and is easy to store or disassemble.

SUMMARY OF THE INVENTION

It is therefore an object of the present invention to provide for a novel and improved suspension frame, which is economical to manufacture. It is another object of the present invention to provide for a novel and improved suspension frame that is easy to assemble and disassemble.

It is another object of the present invention to provide for a novel and improved suspension frame that adequately and safely supports a recreational swing as well as an adult user.

It is another object of the present invention to provide for a novel and improved suspension frame that is stable with heavier loads of suspension.

It is a further object of the present invention to provide for a novel and improved suspension frame having a height adjustment feature as well as an optional motorized feature for mechanical rotation of the suspension device.

It is a final object of the present invention to provide for a novel and improved suspension frame that is lightweight, easily portable and of rugged construction.

In accordance with the present invention, there has been devised an apparatus for suspending a recreational swing and similar devices comprising a plurality of upwardly convergent leg members intersecting one another at upper ends, a mounting plate having a plurality of openings at equally spaced circumferential intervals for extension of the upper ends of the leg members above their point of intersection, and traversing means for connecting the leg members in hinged relation to the mounting plate. The mounting plate includes a center suspension device for attachment of a swing or the like and the leg members include bracing members connecting the leg members to each other as well as a swing limitation member. There is also a height adjustment feature as well as an optional motorized feature for mechanical rotation of the suspension device. In another form, there is a swing apparatus for suspending a device comprising a circular apex member having a plurality of openings spaced at uniform intervals from one another, suspension means centrally attached to an underside of the apex member for attachment of the swing therefrom and at least three leg members including extension legs having distal ends which are inserted into attachment means disposed on an underside of the apex member for securely fastening the apex member to the leg members.

The above and other objects, advantages and features of the present invention will become more readily appreciated and understood from a consideration of the following detailed description of preferred and modified forms of the present invention when taken together with the accompanying drawings in which:

DETAILED DESCRIPTION

Figure 1:
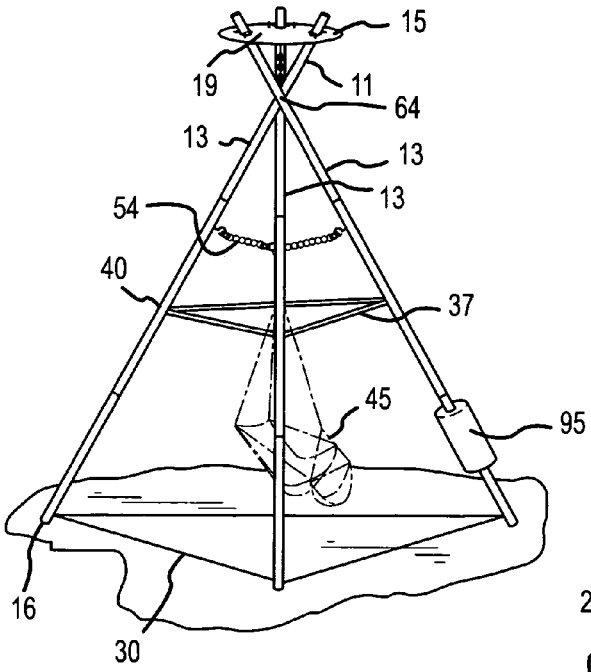
FIG. 1 is a perspective view of a form of suspension frame in accordance with the present invention.
Figure 2:
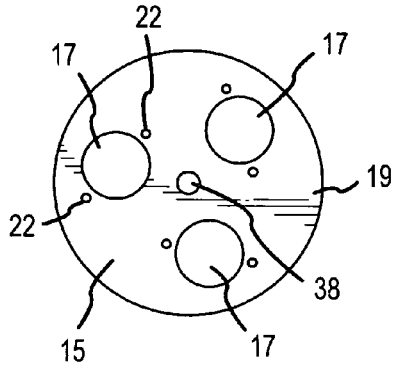
FIG. 2 is a top plan view of a form of suspension frame of the present invention.
Figure 4:
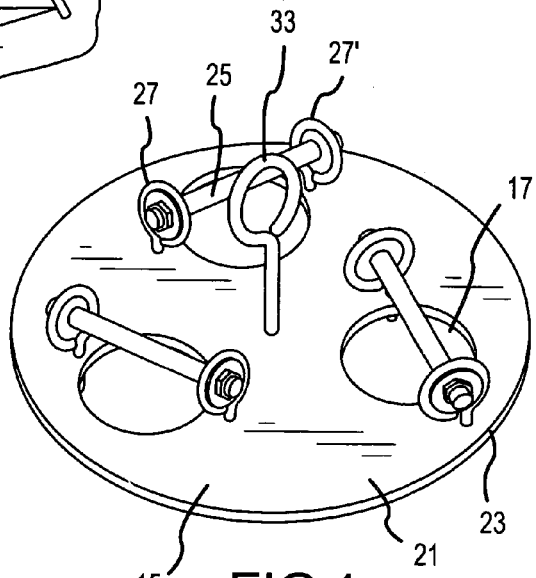
FIG. 4 is a perspective view of the underside of the mounting plate of the suspension frame in accordance with the present invention.
Figure 3:
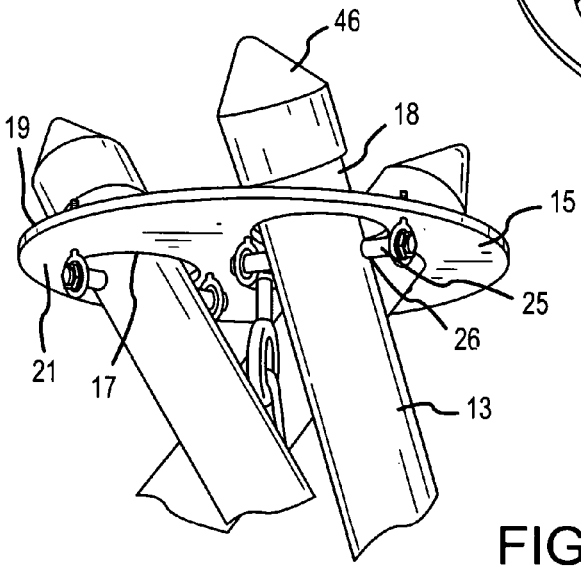
FIG. 3 is a perspective fragmentary view of the apex portion of the suspension frame in accordance with the present invention.
Figure 5:
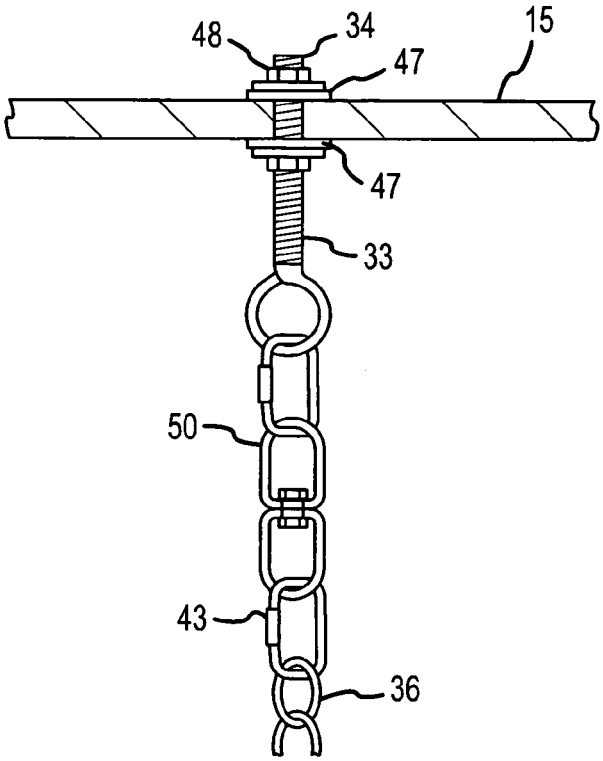
FIG. 5 is a perspective view of the frame suspension system showing a suspension assembly in accordance with the present invention.
Figure 6:
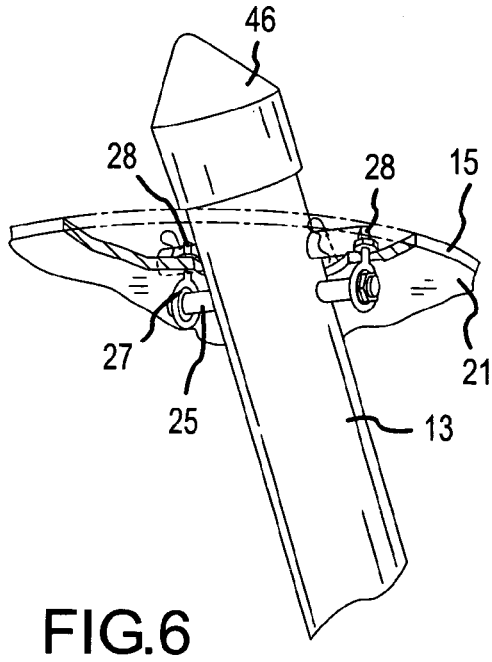
FIG. 6 is a perspective fragmentary view of a leg support of the suspension frame in accordance with the present invention.

Referring in more detail to FIGS. 1 through 11, there is provided a suspension apparatus 11 as shown in FIG. 1 having a plurality of upwardly convergent leg members 13 having end caps 46 which are inserted through an apex member or mounting plate 15 which is also shown in FIGS. 2, 3 and 4. The mounting plate 15 is formed of ¼" aluminum but not limited to that material and includes equally spaced circumferential openings 17 which are designed to accommodate insertion of upper ends 18 of the leg members 13. The rounded openings 17 are sized to permit passage of the leg members 13 while also allowing for a degree of lateral movement of the leg members 13. Further, the circumference of the openings 17 of the mounting plate 15 allows the leg members 13 to be aligned parallel to one another and easily transported or stored. The mounting plate 15 is preferably circular for ease of transporting, lack of sharp edges and weight minimization. Each of the openings 17 receives an end of a leg member 13 designed to be inserted therethrough. The leg members are comprised of 2 ⅜" galvanized pipe but may be fabricated of any other suitable material or size. The mounting plate 15 includes a top surface 19 and a bottom surface 21 which are both planar and side edges 23 connecting the top and bottom planar surfaces 19 and 21 as shown in FIG. 3. The mounting plate 15 includes fastener or pivot members 25 which traverse each of the openings 17 of the mounting plate 15 and are designed to connect the leg members 13 in hinged relation to the mounting plate 15 as shown in FIGS. 3 and 4. The pivot members 25 are in the form of bolts which pass through aligned sleeves 26 located near the end of each of the leg members 13. Dual eyebolts 27, 27' are inserted through diametrically opposed bores 22 flanking each of the openings 17 as shown in FIG. 2 and secured at the top surface 19 with a fastener 28, such as, a hex nut as shown in FIG. 6. Each pivot member 25 extends through the first eyebolt 27 at one end through the aligned sleeves 26 and through the second eyebolt 27' at the opposite end. The pivot members 25 are then secured with the fastener, such as, a fender washer and hex nut 28 at each end. The pivot members 25 are disposed below the mounting plate 15 and attached to the bottom surface 21. The pivot members 25 allow the leg members 13 to be easily attached to the mounting plate 15 when first assembling the apparatus. Further, the location of the pivot members 25 help to offset the downward force exerted on the mounting plate 15 when a suspension swing 45 is suspended from the mounting plate 15. The pivot members 25 aid as well in stabilizing the leg members 13 and also act as stops, preventing the mounting plate 15 from advancing downwardly on the leg members 13.

Figure 8:
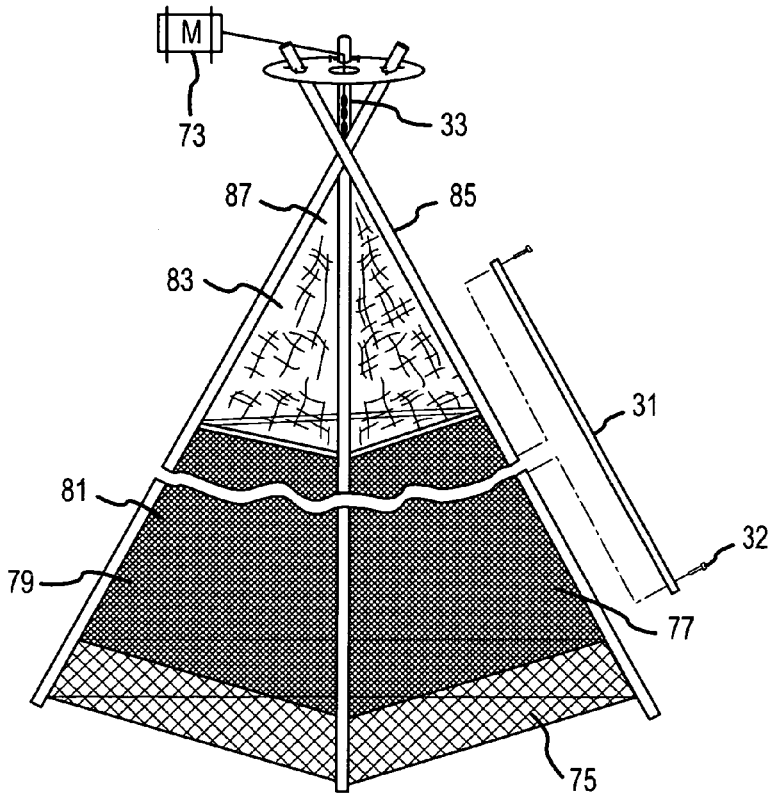
FIG. 8 is a perspective view of a motorized form with optional features of suspension frame in accordance with the present invention.

Leg extension members 31, as shown in FIG. 8, may be added to the leg members 13 to increase the height. The extension members 31 are typically 2 ⅜" galvanized pipe with a mandrelled or swedged end for insertion into respective ends of the leg members 13. The extension members 31 are held in place with cotter pins 32 which are passed through aligned bores on the extension members 31 and the leg members 13. Any other type of retention member may also be used. The length of the extension members 31 is typically in 8' sections. The leg members 13 are typically 8' in length as well to allow for ease of portability. The height of the apparatus 11 may be adjusted accordingly with the extension members 31. If an indoor use is desired, the height may be adjusted accordingly to accommodate 10' ceilings. If an outdoor use is desired, the height may be adjusted up to 48' while still retaining stability of the apparatus 11. It is also possible to adjust the height beyond 48', depending on the user's requirements.

Suspension means which is in the form of a suspension member 33, such as, an eyebolt or swivel eyelet attached to an eyebolt is attached to the bottom surface 21 of the mounting plate 15 as shown in FIGS. 3, 4 and 5 and attached to a chain 36. The upper portion 34 of the suspension bolt 33 is inserted through a center opening 38, as shown in FIGS. 2 and 5, and secured to the mounting plate 15 with a series of fender washers 47 and lock nuts 48 above and below the mounting plate as shown in FIG. 5. Lock nuts may include locking nuts with adhesive. The suspension bolt 33 in combination with the mounting plate 15 and the leg members 13 acts as a suspension platform for the suspension swing 45 attached to the suspension bolt 33 with the chain 36. The chain 36 is preferably made up of chain link members of sufficient lengths to suspend the suspension swing a predetermined distance above the ground. The suspension swing 45 may take a number of different forms and is simply designed to hold the weight of an adult user or users and provide for recreational use. An eye to eye swivel 50 may be attached to the suspension bolt 33, which will allow a user to freely rotate the suspension swing and vehicle 45 attached to the chain 36 as shown in FIG. 5. Eyelet 50 or quick links 43 may be used to connect the chain 36 and the suspension member 33 via an eye-to-eye swivel 50. This is shown in FIG. 5.

Figure 11:
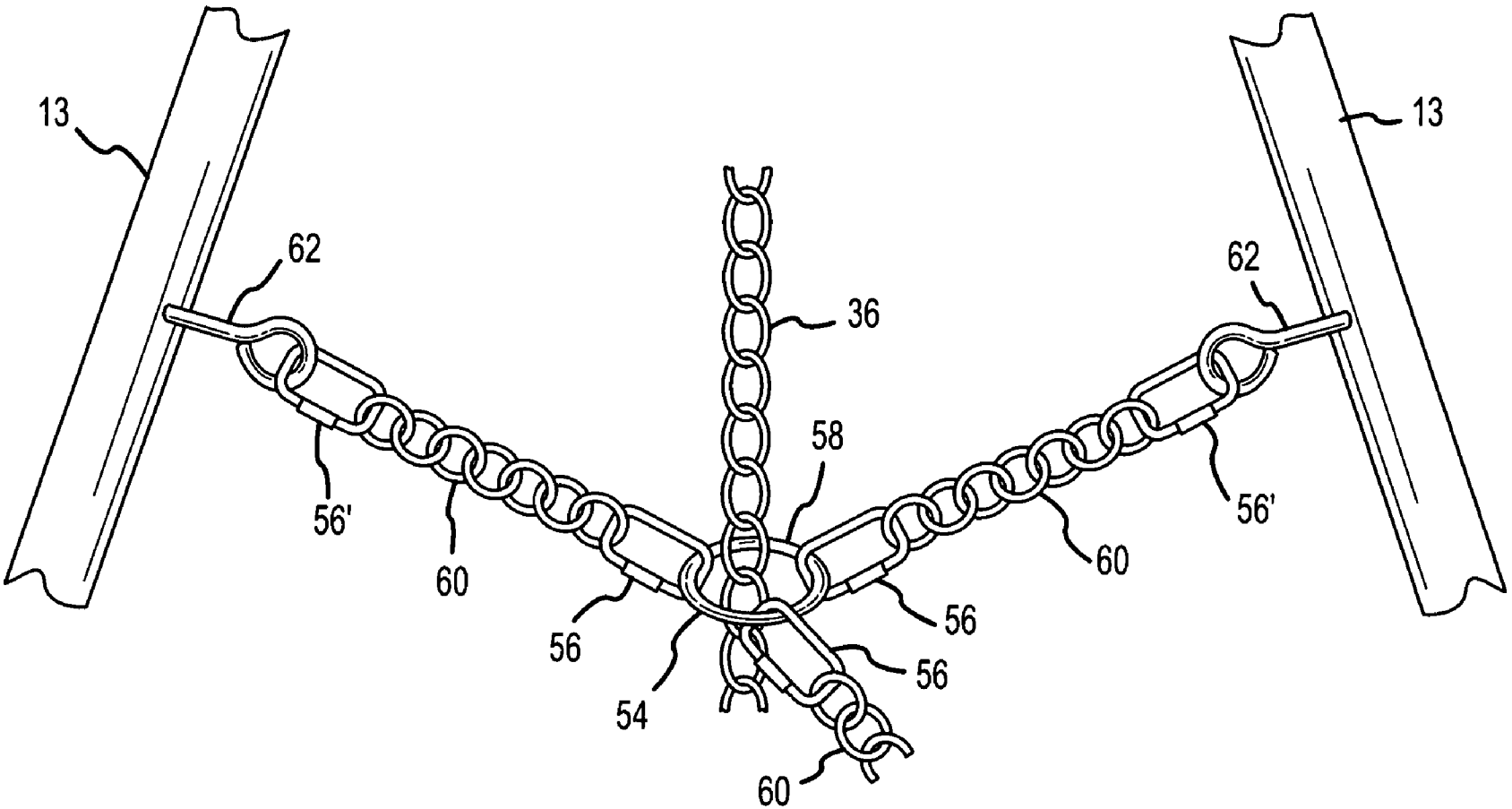
FIG. 11 is a perspective fragmentary view of a swing limitation member in accordance with the present invention.

Attached to the leg members 13 is a limiting means in the form of a swing limiting member 54 as shown in FIGS. 1 and 11. The limiting member 54 may include interlocking quick links 56 which are attached to a stainless steel guide ring 58 at one end and chain link member 60 at an opposite end. The chain link member 60 is then attached to another quick link 56' which has an opposite end linked to a hook or eyebolt 62 which is secured to each of the leg members 13. Alternatively, a merged chain opening (not shown) may take the place of the stainless steel guide ring 58. The merged chain opening is created by each quick link 56 connected at an end link to each other forming a simple merged link. The suspension swing chain 36 passes through the guide ring 58 or merged chain opening (not shown) at an upper portion of the suspension apparatus 11. The limiting member 54 acts to limit or retard the extension or arc of the chain 36 and the swing 45 outside of the leg members 13 by lowering the pivot point of the suspension swing 45. This enables the user to swing freely with a lowered risk of injury from over swinging and coming into contact with the leg members 13. In the absence of the limiting member 54, the pivot point of the suspension swing 45 is located at or near the intersection point 64 of the leg members 13 as shown in FIG. 1. This can result in an increased arc of swing of the swing member 45. As a result of including the limiting member 54, the suspension chain 36 has a pivot point about the guide ring 58. The chain links 60 are preferably attached approximately 5' below the mounting plate 15.

Figure 7:
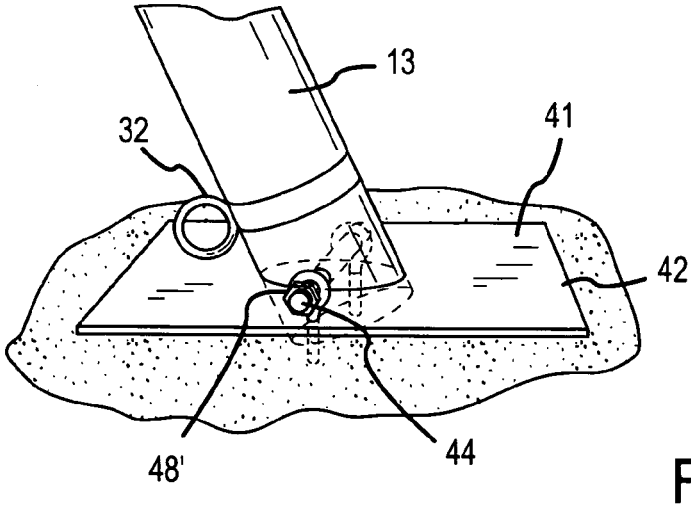
FIG. 7 is a perspective view of an optional base of the suspension frame in accordance with the present invention.

There are additional features, which are optional to the apparatus 11 including a bracing or sand foot 41 as shown in FIG. 7 which may be attached to the leg member 13 and includes a platform 42 which may be placed on sand or any other type of unstable terrain, a bolt member 44 which attaches the leg member 13 to the sand foot 41 and a hex nut 48' for securing the bolt member 44. The sand foot 41 is attached to each of the leg members 13 to provide further stabilization of the apparatus 11. Also shown in FIG. 7 is an eyelet band 32 secured around the leg member 13. Another optional feature is shown in FIG. 1 in which a plurality of bracing members 37 are formed of 1" galvanized pipe or other suitable material and size and are secured along a midpoint 40 of the leg members 13. The bracing pipes 37 provide further stabilization to the apparatus 11 while preventing the leg members 13 from shifting or spreading beyond a desired point. The bracing pipes 37 are preferably attached to the leg members 13 with cotter pins or a similar retention device.

Another feature which is shown in FIG. 1, are lower leg stabilization members 30 which are formed of nylon rope or any other suitable material and are connected to the eyelet band 32 of the leg members 13 to prevent spreading or separation of the leg members. FIG. 8 demonstrates another optional feature, a motor 73 which is attached to the suspension bolt 33 resulting in a motorized rotation or movement of the suspension swing 45. In use, the electric motor 73 is attached to a first fulcrum plate (not shown). A fulcrum (not shown) which is also attached to the first fulcrum plate at one end moves in a forward direction due to rotation of the first fulcrum plate by the motor 73. An opposite end of the fulcrum is attached to a second fulcrum plate (not shown) which rotates in a counter direction to the first fulcrum plate. The chain 36 is attached to the opposite end of the fulcrum, resulting in rotation of the chain in a circular motion. Finally, other optional features include a child or pet safety netting 75 which is in the form of a thin mesh fabric attached along the eyelet bands 32 of the leg members 13. The purpose of the safety netting 75 is to prevent a child or pet from entering the suspension area 77 and becoming injured due to the movement of the suspension chair 45. The apparatus 11 may also have an optional mosquito netting 79 which may be placed along an entire panel 81 of the apparatus 11 or solely along a portion of the panel 81. The apparatus 11 may also have shade panels 83 which may be placed along an upper portion 85 of the leg members 13. The shade panels 83 may be fabricated from any type of sun repellant or conditioning fabric and the outer surface 87 may contain corporate logos or designs and the like. Finally, the apparatus may include optional cushion members 95 which may be fastened around the leg members 13 to prevent injury to a user if, while overswinging, the user comes into contact with the leg members 13. This is shown in FIG. 1.

In use, a user inserts the eyebolts 27 and 27' through the sleeves 22 of the mounting plate 15, securing them at the top 19 with the fender washer and hex nut 28. The leg members 13 are inserted through the rounded openings 17 and the pivot members 25 are inserted through the eyebolts 27, 27', the sleeves 26 on the leg members 13 and through the opposite eyebolt 27' and secured with a securing nut 18. A user would then take the leg extension members 31 and add a single extension leg at a time with accompanying lock pins 32 to each respective leg member 13. The height of the apparatus 11 may be further adjusted by adding additional leg extension members 31 as shown in FIG. 8. The frame 11 is not limited to leg extension members 31 with mandrelled ends for insertion into the leg members 13. Telescoping legs (not shown) could also be substituted for the leg extension members 31. The suspension swing or chair 45 or any other type of recreational device that the user desires to suspend from the apparatus 11 may be attached to the suspension bolt 33. The leg members 13 are placed in an upright position with the secured mounting plate 15. The leg members 13 are spread uniformly outwardly and, as a result, the mounting plate 15 rotates in a limited clockwise or counterclockwise fashion. The rotation forces the leg members 13 to move into locking engagement with one another at a common intersection point 64 which is below the mounting plate 15. The mounting plate 15, as a result of the rotation, forms a tightening member forcing the leg members 13 to remain in their outward splayed position. The leg members 13 converge at the point 64 below the mounting plate 15 and then diverge above the mounting plate 15. This results in a highly stable apparatus capable of suspending and supporting a weight of 450 lbs. or more. The weight of the user and gravitational forces pull the chain 36, the suspension bolt 33 along with the mounting plate 15 in a downward direction, forcing the mounting plate 15 to rest securely on the upwardly convergent leg members 13 as well as the pivot members 25. The configuration of the leg members 13 in combination with the pivot members 25 and their location below the mounting plate 15, results in an extremely stable tripod framework, which is held in place with the mounting plate 15. The mounting plate 15 along with base cables or ropes 30 act to prevent the leg members 13 from shifting and results in a stable framework for the suspension swing 45.

Figure 9:
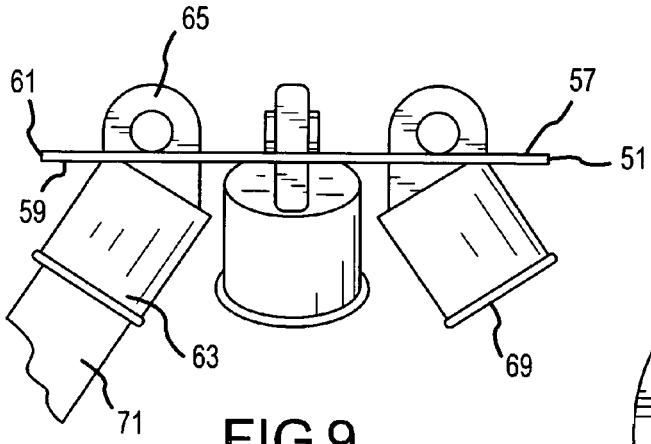
FIG. 9 is a side view of an optional form of mounting assembly in accordance with the present invention.
Figure 10:
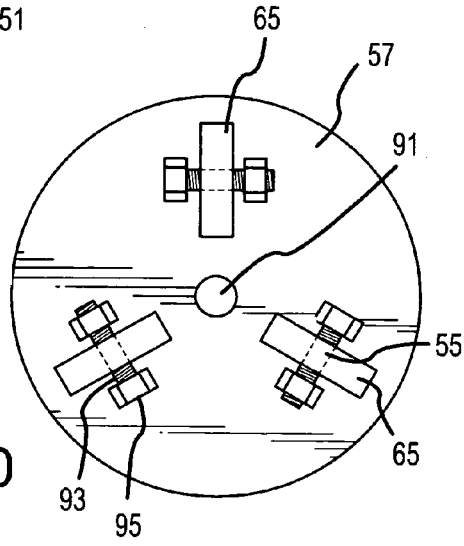
FIG. 10 is a top plan view of the top surface of the mounting plate shown in FIG. 9.

An alternate form of mounting plate 51 is shown in FIGS. 9 and 10. The mounting plate or apex member 51 has a top surface 57, a bottom surface 59 and adjoining side edges 61. There are narrow straight or angled openings or slots 55 at spaced intervals designed to accommodate end bores or connector plates 65 which are attached to attachment or cap members 63. The cap members 63 are preferably in the form of a cup and each have an inner opening 69 which is sized to accommodate distal ends 71 of the leg members 13. The connector plates 65 of the cap members 63 are inserted through the narrow openings 55 and are secured to the mounting plate 51 along a top surface 57 with a bolt member 93 and a locking nut 95. The suspension bolt 33, as previously described, is inserted through an opening 91 on the bottom surface 59 of the mounting plate 51 and secured to the top surface 57 as previously described. The combination of the user's weight and the force of gravity result in a downward pressure that is exerted on the distal ends 71 of the leg members 13. This combination results in a stable framework for the suspension swing 45 or any other load. The leg extension members 31 and other optional features, as described previously, are also designed to be utilized with this form of invention.

It is therefore to be understood that while preferred forms of invention are herein set forth and described, the above and other modifications, including but not limited to the types of materials used, may be made therein without departing from the spirit and scope of the invention as defined by the appended claims and reasonable equivalents thereof.

I claim:

1. Apparatus for suspending a swing and the like comprising:

a plurality of upwardly convergent leg members intersecting one another at a common point of intersection;

a mounting plate having a plurality of openings at spaced circumferential intervals, an upper end of each of said leg members diverging upwardly from said point of intersection through one of said openings above said point of intersection; and means for connecting said upper ends of said leg members in hinged relation to said mounting plate.

2. In apparatus according to claim 1 wherein said connecting means are located on an undersurface of said mounting plate.

3. In apparatus according to claim 1 wherein said openings are sized to accommodate slight lateral movement of said leg members.

4. In apparatus according to claim 1 wherein said connecting means include eyebolts, bolt members and pivot sleeves.

5. In apparatus according to claim 1 wherein said leg members include a plurality of sections connected to increase the length of said leg members.

6. In apparatus according to claim 1 wherein said mounting plate includes means for suspension of a swing member.

7. In apparatus according to claim 6 wherein said suspension means includes an eye bolt, a swivel eyelet and a chain member.

8. In apparatus according to claim 6 wherein said suspension means includes means for limiting the arc of swing of said swing member.

9. In apparatus according to claim 8 wherein said limiting means includes a guide ring and a plurality of chain lengths releasably secured to said leg members.

10. In apparatus according to claim 6 wherein said suspension means includes means for mechanical movement of said suspension device.

11. In apparatus according to claim 1 wherein said leg members include bracing members connecting each of said leg members to each other.

12. In apparatus according to claim 1 wherein rotation of said mounting plate in response to spreading of said leg members imparts a twisting motion to said leg members causing said leg members to move into locking engagement with one another at their common intersection point beneath said mounting plate.

13. In apparatus according to claim 1 wherein said upper ends of said leg members diverge from one another at a point beneath said mounting plate.

14. In apparatus according to claim 1 wherein said leg members include a bracing foot member.

15. Recreational apparatus for suspending a swing comprising:

at least three upwardly convergent leg members;

an apex member having a plurality of equally spaced circumferential openings corresponding to each of said leg members, said apex member having a top planar surface and a bottom planar surface;

said leg members having a plurality of attached leg extensions;

a suspension member centrally attached to said bottom planar surface of said apex member;

said suspension member including means for limiting the swinging motion of said swing;

fastener pivot members secured to said bottom surface, connecting said leg members to said apex member; and said pivot members including bolt members and aligned sleeves in said leg members.

16. In apparatus according to claim 15 wherein said limiting means includes a guide ring and a plurality of chain links releasably connected to said leg members.

17. In apparatus according to claim 15 wherein said leg members include lower leg stabilization members.

18. In apparatus according to claim 15 wherein distal ends of said leg members extend through said openings.

19. In apparatus according to claim 15 wherein said leg members intersect at upper ends prior to extension through said openings.

20. In apparatus according to claim 15 wherein said pivot members include said bolt members passing through said sleeves in said leg members resulting in a pivotal connection between each of said leg members and said apex member.

21. An apparatus for suspending a device including at least three leg members comprising:

a circular apex member having means for securing said apex member to distal ends of said leg members;

a plurality of spaced openings on said apex member;

said securing means including connector plates extending through said openings on said apex member;

said leg members having distal ends enclosed within said securing means; and bolt members securely fastening said connector plates to said apex member.

22. In apparatus according to claim 21 wherein said distal ends of said leg members are connected to an underside of said apex member with said securing means.

23. In apparatus according to claim 21 wherein said securing means include an end cap for enclosing said distal ends of said leg members.

24. In apparatus according to claim 23 wherein said securing means include said connector plates attached to said end caps, said connector plates secured to a top surface of said apex member with said bolt members.

25. Recreational apparatus for suspending a swing comprising:

at least three upwardly convergent leg members;

a mounting plate having a plurality of equally spaced slot members, said mounting plate having a top planar surface and a bottom planar surface;

said leg members having a plurality of attached leg extensions;

a suspension member centrally attached to said bottom planar surface of said mounting plate;

means for retarding the motion of said swing;

securing members having end caps mounted on distal ends of said leg members;

said end caps including connector plates extending through said slot members on said mounting plate; and said connector plates secured to said top surface of said mounting plate with bolt members.

26. In apparatus according to claim 25 wherein said retarding means includes a guide ring or a plurality of interlocking chain links releasably connected to said leg members.

27. In apparatus according to claim 25 wherein said leg members include bracing members connecting each of said leg members to each other.

28. In apparatus according to claim 25 wherein said suspension member includes means for mechanical rotation of said swing.

* * * * *